US010947947B2

(12) United States Patent
Tanaya

(10) Patent No.: US 10,947,947 B2
(45) Date of Patent: Mar. 16, 2021

(54) IGNITION APPARATUS

(71) Applicant: Mitsubishi Electric Corporation, Tokyo (JP)

(72) Inventor: Kimihiko Tanaya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 7 days.

(21) Appl. No.: 15/941,663

(22) Filed: Mar. 30, 2018

(65) Prior Publication Data

US 2019/0128234 A1 May 2, 2019

(30) Foreign Application Priority Data

Oct. 26, 2017 (JP) ..... JP2017-206958

(51) Int. Cl.
*F02P 9/00* (2006.01)
*F02P 3/04* (2006.01)
(Continued)

(52) U.S. Cl.
CPC ..... *F02P 9/002* (2013.01); *F02P 3/0435* (2013.01); *F02P 5/145* (2013.01); *F02P 17/12* (2013.01);
(Continued)

(58) Field of Classification Search
CPC .... F02P 3/01; F02P 3/04; F02P 3/0435; F02P 9/002; F02P 9/007; F02P 11/06; F02P 15/08; F02P 15/10; F02P 17/12
See application file for complete search history.

(56) References Cited

U.S. PATENT DOCUMENTS

2003/0200023 A1* 10/2003 Matsushita ..... F02P 17/12 701/114
2003/0217587 A1* 11/2003 Inada ..... G01M 15/11 73/35.08
(Continued)

FOREIGN PATENT DOCUMENTS

JP 2000199470 A 7/2000
JP 3917185 B2 5/2007
(Continued)

OTHER PUBLICATIONS

Communication dated Aug. 14, 2018, from the Japanese Patent Office in counterpart application No. 2017-206958.

*Primary Examiner* — John M Zaleskas
(74) *Attorney, Agent, or Firm* — Sughrue Mion, PLLC; Richard C. Turner

(57) ABSTRACT

The ignition apparatus includes: an ignition plug; a plurality of high voltage devices each configured to generate the high voltage and apply the high voltage between the first electrode and the second electrode; a leakage current detection device configured to detect a leakage current flowing between the first electrode and the second electrode; and a control device configured to control respective operations of the plurality of high voltage devices and the leakage current detection device. When the control device determines that leakage is present between the first electrode and the second electrode based on the leakage current detected by the leakage current detection device, the control device causes each of the plurality of high voltage devices to apply the high voltage between the first electrode and the second electrode at the same period.

13 Claims, 7 Drawing Sheets

(51) Int. Cl.

| | |
|---|---|
| ***F02P 5/145*** | (2006.01) |
| ***F02P 17/12*** | (2006.01) |
| *F02P 11/06* | (2006.01) |
| *F02P 3/01* | (2006.01) |

(52) U.S. Cl.
CPC . *F02P 3/01* (2013.01); *F02P 3/04* (2013.01); *F02P 11/06* (2013.01)

(56) References Cited

U.S. PATENT DOCUMENTS

2009/0108846 A1* 4/2009 Koda ..... F02D 35/021 324/391
2009/0173315 A1* 7/2009 Inada ..... F02P 17/12 123/406.26
2010/0089361 A1* 4/2010 Inada ..... F02P 17/12 123/406.12
2010/0257921 A1* 10/2010 Tanaya ..... G01M 15/042 73/114.67
2011/0088646 A1* 4/2011 Tanaya ..... F02P 5/15 123/179.3
2012/0017881 A1* 1/2012 Kataoka ..... F02P 3/051 123/621
2012/0186569 A1* 7/2012 Shimakawa ..... F02P 15/10 123/644
2012/0286791 A1* 11/2012 Tanaya ..... F02D 35/021 324/393
2013/0092136 A1* 4/2013 Tanaya ..... F02P 15/005 123/634
2013/0241429 A1* 9/2013 Ruan ..... F02P 3/053 315/220
2014/0102412 A1* 4/2014 Czekala ..... F02P 3/04 123/406.12
2014/0316673 A1* 10/2014 Glugla ..... F02P 3/051 701/102
2014/0360476 A1* 12/2014 Huberts ..... F02P 9/002 123/609
2015/0152832 A1* 6/2015 Desai ..... F02P 9/002 123/625
2015/0192100 A1* 7/2015 Kurahashi ..... F02P 15/08 123/406.12
2015/0322900 A1* 11/2015 Tanaya ..... F02M 26/49 123/568.21
2016/0138553 A1* 5/2016 Senior ..... G01M 15/11 73/114.62
2016/0201636 A1* 7/2016 Inada ..... F02P 5/15 123/625
2016/0348634 A1* 12/2016 Desai ..... F02P 9/002
2017/0022959 A1* 1/2017 Huberts ..... F02P 3/05
2017/0022961 A1* 1/2017 Toriyama ..... F02P 3/0442
2017/0067434 A1* 3/2017 Ruan ..... F02P 3/053
2017/0284356 A1* 10/2017 Takeda ..... F02P 3/05
2017/0292492 A1* 10/2017 Inada ..... F02P 1/083
2017/0350362 A1* 12/2017 Glugla ..... F02D 35/023
2018/0258901 A1* 9/2018 Terada ..... F02P 9/002

FOREIGN PATENT DOCUMENTS

JP 2009162175 A 7/2009
JP 2011069232 A * 4/2011
JP 2011226379 A 11/2011
JP 2015124714 A 7/2015
JP 2015214896 A 12/2015
JP 2016196848 A 11/2016
JP 201744068 A 3/2017

* cited by examiner

[FIG. 1]
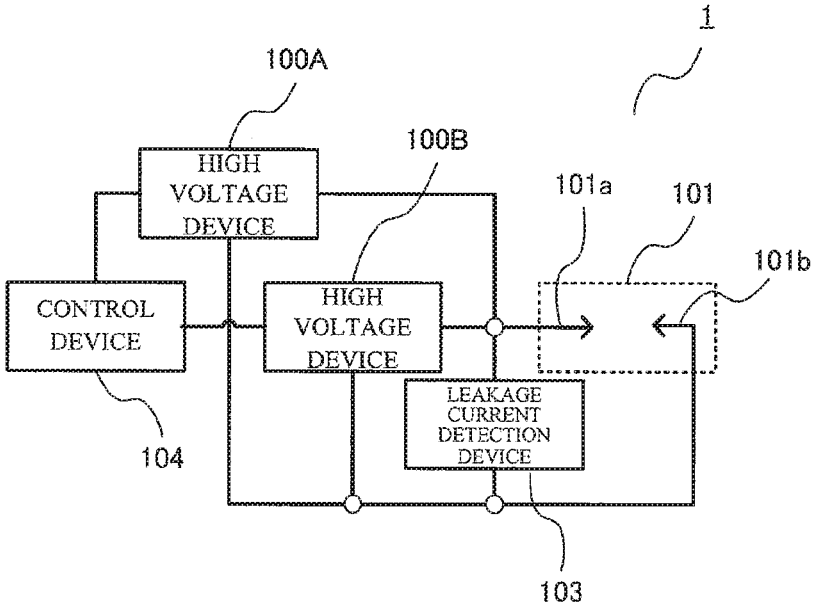

[FIG. 2]
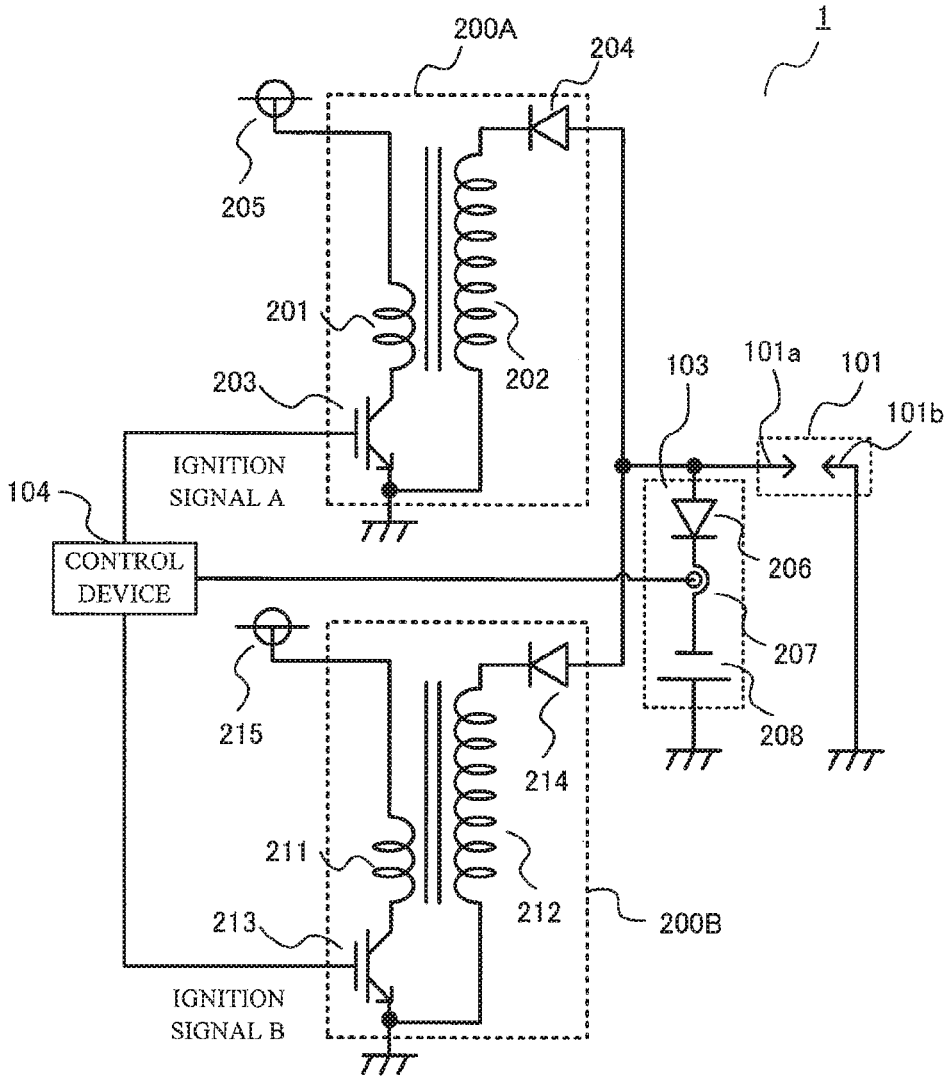

[FIG. 3]
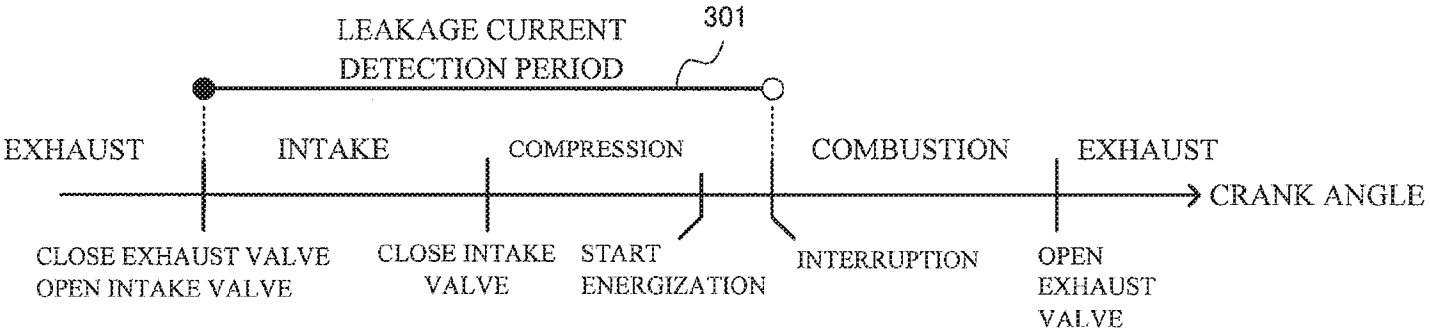

[FIG. 4]
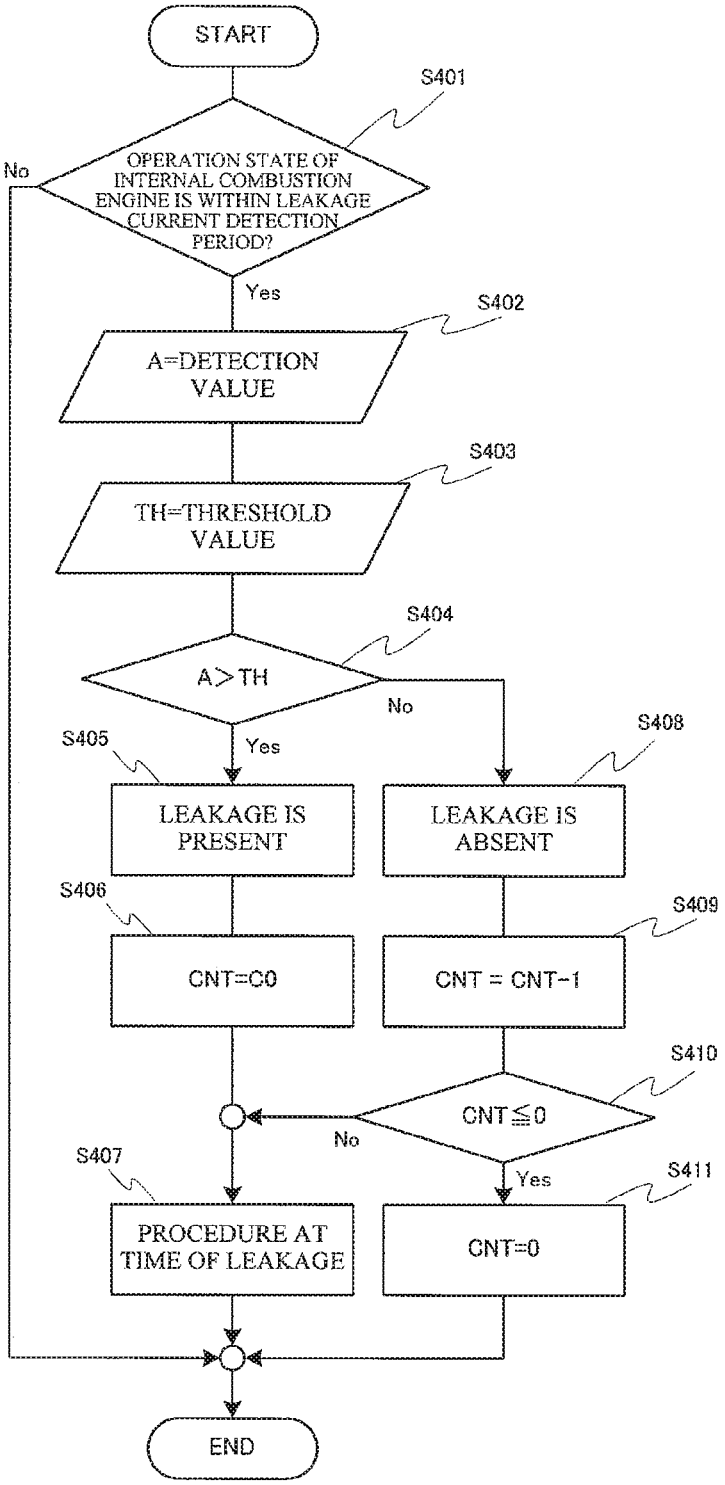

[FIG. 5]
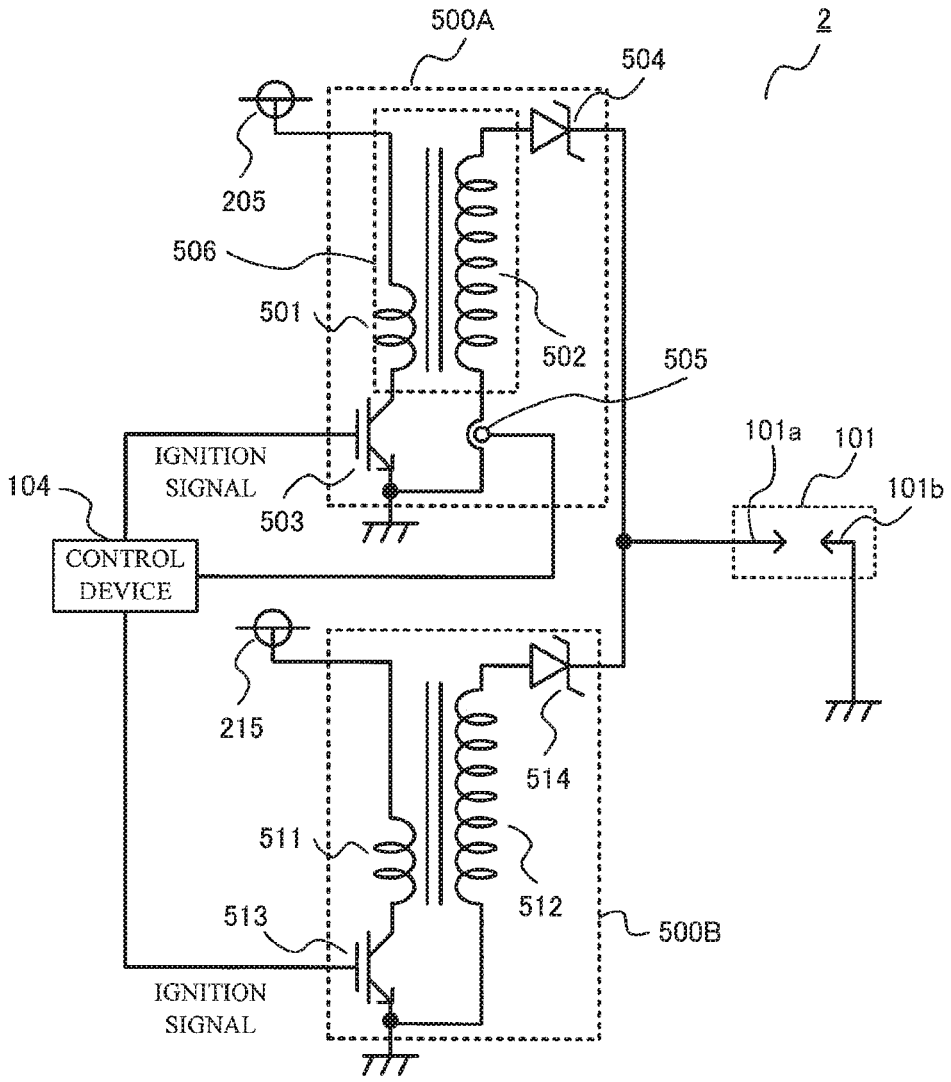

[FIG. 6]
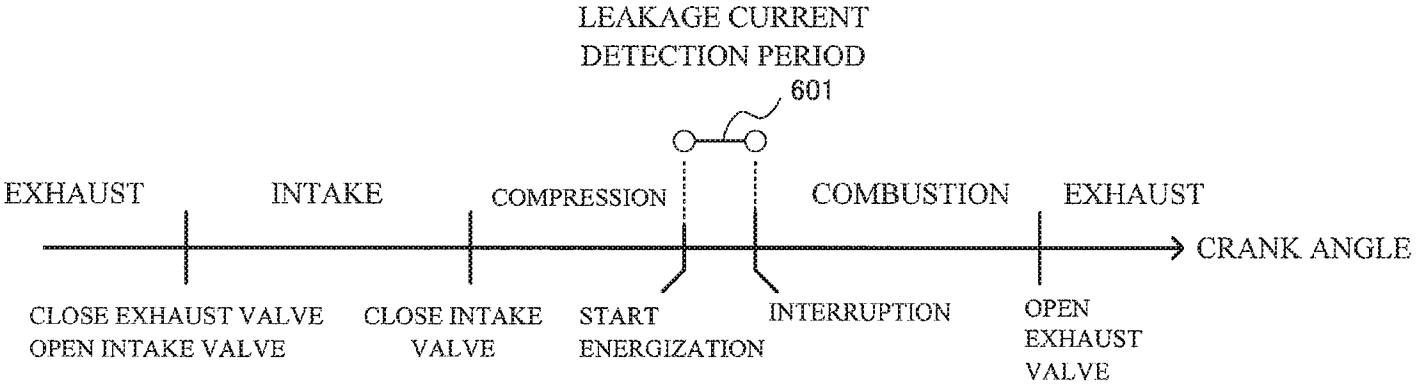

[FIG. 7]
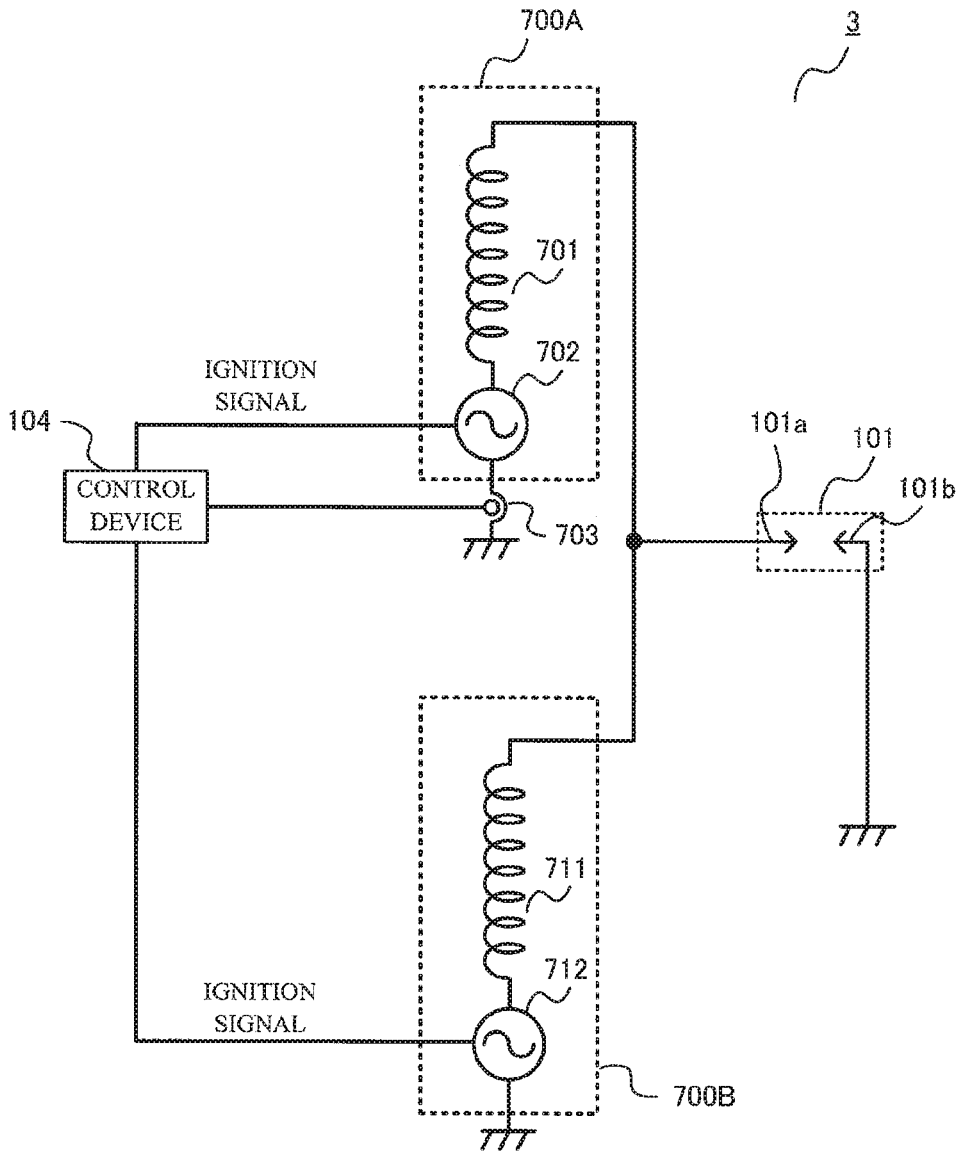

IGNITION APPARATUS

BACKGROUND OF THE INVENTION

1. Field of the Invention

The present invention relates to an ignition apparatus to be used mainly in an internal combustion engine for an automobile.

2. Description of the Related Art

In recent years, issues of environmental conservation and fuel depletion have been raised, and the automobile industry is also urgently required to take countermeasures against those issues. As an example of the countermeasures, there is given ultra-lean combustion (hereinafter referred to as "stratified charge lean combustion") operation of an internal combustion engine through use of a stratified charge mixture. However, the operation of the internal combustion engine by the stratified charge lean combustion has a problem in that smoldering is liable to occur in an ignition plug due to a distribution variation in combustible gas mixture in a combustion chamber of the internal combustion engine. In particular, in spray guide type stratified charge lean combustion operation that involves directly spraying fuel to the vicinity of the ignition plug, smoldering in the ignition plug becomes more significant.

When smoldering occurs without vigorous ignition of the ignition plug, ignition energy leaks from an electrode (hereinafter referred to as "first electrode") of the ignition plug supplied with a voltage to an electrode (hereinafter referred to as "second electrode") thereof set to a ground level (hereinafter referred to as "GND level") through conductive carbon, iron oxide, or the like forming the smoldering. Therefore, there is a problem in that a gap between the first electrode and the second electrode of the ignition plug does not reach dielectric breakdown (hereinafter sometimes referred to as "complete dielectric breakdown"), and spark discharge is not generated.

Alternatively, time required for the gap between the first electrode and the second electrode to reach complete dielectric breakdown becomes longer due to the leakage of the ignition energy. Therefore, actual ignition timing is shifted to a retarded side. As a result, there is a problem in that the output from the internal combustion engine decreases.

Further, in recent years, the ignition plug tends to be reduced in thickness or elongated. With this, the grounded electrostatic capacitance of the ignition plug tends to increase. In combination with the influence of an increase in voltage required in the ignition plug in association with an increase in compression ratio of the internal combustion engine, there is increasing influence of an energy leakage path formed by smoldering in the ignition plug on the ignition performance of the internal combustion engine.

In order to solve the above-mentioned problems, there has hitherto been proposed an ignition apparatus that eliminates smoldering in the ignition plug with spark discharge (see, for example, Japanese Patent No. 3917185). In the ignition apparatus of Japanese Patent No. 3917185, carbon forming smoldering in the ignition plug is eliminated by causing the ignition plug to perform spark discharge during a period in which a combustible gas mixture is ignited and during a period from the time when the combustible gas mixture is ignited to the time when next fuel injection is started.

SUMMARY OF THE INVENTION

However, the related art has the following problem.

When a leakage path is once formed by smoldering between the first electrode and the second electrode of the ignition plug, the electrostatic capacitance required for spark discharge cannot be charged. Therefore, there is a problem in that spark discharge for eliminating smoldering as disclosed in Japanese Patent No. 3917185 cannot be generated.

The present invention has been made to solve the above-mentioned problem, and it is an object of the present invention to provide an ignition apparatus capable of reliably generating spark discharge even under a state in which a leakage path is formed in the ignition plug by smoldering.

According to one embodiment of the present invention, there is provided an ignition apparatus, including: an ignition plug, which includes a first electrode and a second electrode arranged through intermediation of a gap, and is configured to ignite a combustible gas mixture in a combustion chamber of an internal combustion engine by generating discharge in the gap when a predefined high voltage is applied between the first electrode and the second electrode; a plurality of high voltage devices each configured to generate the high voltage and apply the high voltage between the first electrode and the second electrode; a leakage current detection device configured to detect a leakage current flowing between the first electrode and the second electrode; and a control device configured to control respective operations of the plurality of high voltage devices and the leakage current detection device, in which, when the control device determines that leakage is present between the first electrode and the second electrode based on the leakage current detected by the leakage current detection device, the control device causes each of the plurality of high voltage devices to apply the high voltage between the first electrode and the second electrode at the same period.

The ignition apparatus according to the present invention has a configuration in which at least two high voltage devices are operated at the same period when the control device determines that leakage is present between the first electrode and the second electrode. As a result, it is possible to obtain the ignition apparatus capable of reliably generating spark discharge even under the state in which a leakage path is formed in the ignition plug by smoldering.

BRIEF DESCRIPTION OF THE DRAWINGS

FIG. 1 is a schematic diagram of an ignition apparatus according to a first embodiment of the present invention.

FIG. 2 is a configuration diagram of the ignition apparatus according to the first embodiment.

FIG. 3 is an explanatory diagram of a leakage current detection period in the first embodiment.

FIG. 4 is a flowchart of ignition control processing in the first embodiment.

FIG. 5 is a configuration diagram of an ignition apparatus according to a second embodiment of the present invention.

FIG. 6 is an explanatory diagram of a leakage current detection period in the second embodiment.

FIG. 7 is a configuration diagram of an ignition apparatus according to a third embodiment of the present invention.

DESCRIPTION OF THE EMBODIMENTS

Description is now given of an ignition apparatus according to embodiments of the present invention with reference to the accompanying drawings.

First Embodiment

FIG. 1 is a schematic configuration diagram of an ignition apparatus 1 according to a first embodiment of the present invention.

First, description is given of the problem which arises in the related art when a leakage path is present between a first electrode and a second electrode of an ignition plug.

In order to form a discharge path for generating spark discharge between a first electrode and a second electrode of an ignition plug, it is necessary to charge capacitance (hereinafter referred to as "floating capacitance") between the electrodes to a predefined high voltage (hereinafter referred to as "dielectric breakdown voltage"). Charging of the floating capacitance is performed with an output current (hereinafter sometimes referred to as "charge current") output from a high voltage device under a state in which the first electrode is supplied with a high voltage and the second electrode is set to a GND level.

In this case, when a leakage path is present between the first electrode and the second electrode, a part of the output current flows to the leakage path. Therefore, the floating capacitance cannot be charged to the dielectric breakdown voltage. Alternatively, even when the floating capacitance can be charged to the dielectric breakdown voltage, a longer charge time is required as compared to the case in which a leakage path is not present.

For example, when an output current value of the high voltage device is represented by $I_O$, and a resistance value of the leakage path is represented by $R_L$, it is considered that the floating capacitance can be charged to $I_O \times R_L$[V] at a maximum. For example, in the case of $I_O$=50 mA and $R_L$=0.5 MΩ, the floating capacitance can be charged to $I_O \times R_L$=50 mA×0.5 MΩ=25 kV.

Thus, when the floating capacitance has a dielectric breakdown voltage of 40 kV, the floating capacitance cannot be sufficiently charged, and hence it is impossible to generate spark discharge. The above-mentioned calculation is approximate calculation, and hence the results may be slightly different from actual results in consideration of the actual magnitude of the floating capacitance, the ability of a supply source of the output current, and the like.

In order to solve the problem in the related art described above, an ignition apparatus 1 according to the first embodiment includes an ignition plug 101, high voltage devices 100A and 100B, a leakage current detection device 103, and a control device 104.

The ignition plug 101 includes a first electrode 101*a* and a second electrode 101*b*. The first electrode 101*a* and the second electrode 101*b* are arranged through intermediation of a predefined gap (hereinafter referred to as "gap" The first electrode 101*a* is an electrode supplied with a high voltage. Meanwhile, the second electrode 101*b* is an electrode set to a GND level.

The ignition plug 101 has a predefined high voltage applied to the first electrode 101*a* to generate spark discharge in the gap between the first electrode 101*a* and the second electrode 101*b*, to thereby ignite a combustible gas mixture in a combustion chamber of an internal combustion engine.

The high voltage devices 100A and 100B are each configured to generate a predefined high voltage and apply the generated high voltage between the first electrode 101*a* and the second electrode 101*b* of the ignition plug 101.

The leakage current detection device 103 is configured to detect a current flowing between the first electrode 101*a* and the second electrode 101*b* at a time of application of a bias voltage for leakage current detection and output the detection result to the control device 104 through a signal line (not shown).

The control device 104 has a function of controlling operations of the high voltage devices 100A and 100B.

Next, the overview of the operation of the ignition apparatus 1 according to the first embodiment is described.

In order to generate spark discharge between the first electrode 101*a* and the second electrode 101*b* of the ignition plug 101 illustrated in FIG. 1, it is necessary to charge the floating capacitance between the first electrode 101*a* and the second electrode 101*b* to a dielectric breakdown voltage.

For the above-mentioned purpose, first, the control device 104 determines whether or not leakage is present between the first electrode 101*a* and the second electrode 101*b* based on the detection result of the leakage current detection device 103. When the control device 104 determines that leakage is present, the control device 104 then operates two high voltage devices 100A and 100B at the same period.

That is, the control device 104 operates the high voltage devices 100A and 100B at the same period to substantially double an output current, thereby being capable of charging the floating capacitance between the first electrode 101*a* and the second electrode 101*b* to the dielectric breakdown voltage even when a leakage path is present between the first electrode 101*a* and the second electrode 101*b*.

In the above-mentioned example, two high voltage devices 100A and 100B are used, but the embodiments of the present invention are not limited thereto. When the number of the high voltage devices is set to N (N is an integer of 2 or more), an output current which is N-times larger can be supplied to the ignition plug 101 by operating the N number of high voltage devices at the same period.

That is, one more high voltage device may be connected in parallel to the high voltage devices 100A and 100B to provide three high voltage devices. A larger number of high voltage devices may be connected in parallel. Further, the plurality of high voltage devices may be packaged separately or arranged in the same package.

A state in which the N number of high voltage devices are operated at the same period refers to a state in which, when there are N number (N is an integer of 2 or more) of high voltage devices, periods in which the N number of high voltage devices output currents overlap each other. That is, when the output current per high voltage device is represented by $I_O$, a state in which there is a period in which a total of output currents output from the N high voltage devices is about $I_O \times N$ corresponds to a state in which the N number of high voltage devices are operated at the same period.

As described above, with the ignition apparatus according to the first embodiment, output currents to be output from the high voltage devices can be set to about N-times by operating the N number (N is an integer of 2 or more) of high voltage devices at the same period. With this, even when leakage is present between the electrodes of the ignition plug, the floating capacitance can be charged to the dielectric breakdown voltage. As a result, spark discharge can be more reliably generated as compared to the related art.

Next, the more detailed configuration and operation of the ignition apparatus 1 according to the first embodiment are described with reference to a configuration diagram of FIG. 2, an explanatory diagram of FIG. 3, and a flowchart of FIG. 4. In the following description, for simplicity of description, the case in which the number of the high voltage devices is set to two is exemplified.

FIG. 2 is an illustration of an example of the case in which ignition coils are used as the high voltage devices 100A and 1001 of FIG. 1. The ignition apparatus 1 illustrated in FIG. 2 includes the ignition plug 101, high voltage devices 200A and 200B, the leakage current detection device 103, and the control device 104. Further, power supplies 205 and 215 illustrated in FIG. 2 are external power supplies such as batteries.

The high voltage device 200A illustrated in FIG. 2 includes a primary coil 201, a secondary coil 202 magnetically connected to the primary coil 201, a switching element 203, and a diode 204. Similarly, the high voltage device 200B includes a primary coil 211, a secondary coil 212 magnetically connected to the primary coil 211, a switching element 213, and a diode 214.

The high voltage device 200A is an ignition coil which is configured to generate a high voltage at the secondary coil 202 by accumulating energy through energization of the primary coil 201 and releasing the accumulated energy when the energization is interrupted. Similarly, the high voltage device 200B is an ignition coil which is configured to generate a high voltage at the secondary coil 212 by accumulating energy through energization of the primary coil 211 and releasing the accumulated energy when the energization is interrupted.

One end of the primary coil 201 is connected to the external power supply 205, and one end of the primary coil 211 is connected to the external power supply 215. Another end of the primary coil 201 is grounded through the switching element 203, and another end of the primary coil 211 is grounded through the switching element 213.

The switching elements 203 and 213 are each capable of switching between energization and interruption of the primary coils 201 and 211 with an ignition signal output from the control device 104. Specifically, the switching element 203 can switch so as to energize the primary coil 201 when an ignition signal A output from the control device 104 is "HIGH" and so as to interrupt the energization of the primary coil 201 when the ignition signal A is "LOW". Similarly, the switching element 213 can switch so as to energize the primary coil 211 when an ignition signal B output from the control device 104 is "HIGH" and so as to interrupt the energization of the primary coil 211 when the ignition signal B is "LOW".

One end of the secondary coil 202 is grounded, and one end of the secondary coil 212 is grounded. Another end of the secondary coil 202 serves as an output terminal of the high voltage device 200A, and another end of the secondary coil 212 serves as an output terminal of the high voltage device 200B. The terminals of the high voltage devices 200A and 200B are connected to the first electrode 101*a* of the ignition plug 101 in parallel through diodes 204 and 214, respectively.

The leakage current detection device 103 is connected between the output terminals of the high voltage devices 200A and 200B and the first electrode 101*a*. The leakage current detection device 103 includes diode 206, a current transformer 207, and a DC power supply 208. The diode 206 is configured to prevent output currents of the high voltage devices 100A and 100B from flowing to the leakage current detection device 103. The current transformer 207 is configured to detect a current flowing through a leakage path.

The DC power supply 208 in the leakage current detection device 103 is configured to apply a bias voltage for leakage current detection between the first electrode 101*a* and the second electrode 101*b* of the ignition plug 101. The leakage current detection device 103 is configured to detect a leakage current in accordance with an instruction from the control device 104 and output the detection result to the control device 104.

For example, when the bias voltage fir leakage current detection is 100 V, and a leakage path of 0.5 MΩ is present between the first electrode 101*a* and the second electrode 101*b*, the current transformer 207 in the leakage current detection device 103 detects a current of 200 μA as the leakage current.

Next, timing fir detecting the above-mentioned leakage current is described with reference to FIG. 3.

FIG. 3 is an explanatory diagram for illustrating a leakage current detection period 301 based on operation timing of the internal combustion engine and energization timing of the primary coils 201 and 211.

FIG. 3, there is illustrated a period in which the operation of the internal combustion engine involves exhaust, intake, compression, combustion, exhaust in the stated order from a retarded side to an advanced side. As the energization timing of the primary coils 201 and 211, timing for starting energization and interrupting the energization is illustrated.

The control device 104 controls the leakage current detection device 103 so that the detection of the leakage current is implemented during the leakage current detection period 301 illustrated in FIG. 3.

The leakage current detection period 301 is set to be a period from the time when exhaust is completed by closing an exhaust valve to the time before combustion is started. The leakage current detection period 301 includes exhaust completion time but does not include combustion start time and energization interruption time. The time before combustion is started can also be set to the time before energization of the primly coils 201 and 211 is interrupted as illustrated, in FIG. 3. After interruption of the energization, high voltages required for spark discharge are supplied from the high voltage devices 100A and 100B to the ignition plug 101.

The leakage current detection period 301 is set to the period as illustrated in FIG. 3 so as to suppress the influence of an ion current in the leakage current detection. During the combustion period and the exhaust period of the internal combustion engine, an ion current caused by an ionized substance filled in the combustion chamber may be generated. Therefore, the ignition apparatus 1 according to the first embodiment is set so as to detect the leakage current during a period in which the ion current is not generated, that is, a period from the time when exhaust is completed by closing the exhaust valve to the time before combustion is started. With this, the detection of the leakage current can be performed with high accuracy.

When the leakage current is sufficiently larger than the ion current, the influence of the ion current becomes negligibly smaller. Therefore, only when the leakage current is large, for example, when it is intended to detect only a strong leakage state in which a leakage path has a resistance of 1 MΩ or less, the influence of the ion current can be ignored. In this case, also during the combustion period and the exhaust period of the internal combustion engine, the detection of the leakage current can be performed.

Next, the operation of the control device 104 is described with reference to the flowchart of FIG. 4.

First, in Step S401, the control device 104 determines whether or not the current operation state of the internal combustion engine is within the leakage current detection period 301. When the current operation state of the internal combustion engine is not within the leakage current detection period 301 (No in Step S401), the control device 104 completes the processing without detecting a current. When the current operation state of the internal combustion engine is within the leakage current detection period 301 (Yes in Step S401), the control device 104 advances the flow to Step S402.

In Step S402, the control device 104 acquires a leakage current detection value from the current transformer 207 in the leakage current detection device 103 and sets the leakage current detection value as a variable A. In this case, the leakage current detection value to be set as the variable A may be one leakage current detection value detected in the leakage current detection period 301, or a median value, an average value, or an integral value of leakage current values detected a plurality of times may be used.

Subsequently, in Step S403, the control device 104 sets a threshold value of the leakage current as a variable TH. The threshold value of the leakage current may be a predefined certain value, or may be set through use of a function corresponding to an engine revolution number, a load, a water temperature, an intake air temperature, and an octane number, or a MAP value.

Subsequently, in Step S404, the control device 104 determines whether or not the variable A is larger than the threshold value TH. When the variable A is larger than the threshold value TH (Yes in step S404), the control device 104 advances the flow to Step S405.

In Step S405, the control device 104 determines that leakage is present between the first electrode 101*a* and the second electrode 101*b* of the ignition plug 101, and advances the flow to Step S406.

In Step S406, the control device 104 sets a predefined maintenance value C0 to a counter value CNT and advances the flow to Step S407. In this case, the maintenance value is a value set in advance as an ignition number period in which a procedure at time of leakage in Step S407 is implemented.

In Step S407, the control device 104 controls the implementation of the procedure at time of leakage, and then completes the processing. That is, the control device 104 outputs ignition signals A and B to the high voltage devices 100A and 100B, respectively; so that the high voltage devices 100A and 100B are operated at the same period.

Returning to the description of Step S404, when the variable A is equal to or less than the threshold value TH (Yes in Step S404) the control device 104 advances the flow to Step S408.

In Step S408, the control device 104 determines that leakage is absent between the first electrode 101*a* and the second electrode 101*b* of the ignition plug 101, and advances the flow to Step S409.

In Step S409, the control device 104 subtracts 1 from the counter value CNT and advances the flow to Step S410.

In Step S410, the control device 104 determines whether or not the counter value CNT is 0 or less. When the counter value CNT is larger than 0 (No in Step S410), the control device 104 advances the flow to Step S407. In Step S407, the control device 104 controls the implementation of the procedure at time of leakage, and then completes the processing.

When the counter value CNT is 0 or less (Yes in Step S410), the control device 104 advances the flow to Step S411. In Step S411, the control device 104 sets the counter value CNT to 0, and then completes the processing.

When the control device 104 once determines in Step S405 that leakage is present, the control device 104 performs control so that the procedure at time of leakage in Step S407 is implemented during the ignition number period set as the maintenance value C0 even when it is determined that leakage is absent the flow illustrated in FIG. 4 to be implemented later.

Further, when it is determined that leakage is present, there is the leakage current larger than the threshold value TH between the first electrode 101*a* and the second electrode 101*b* of the ignition plug 101. Therefore, the charge time for charging the floating capacitance to the dielectric breakage voltage becomes longer. When the control device 104 determines in Step S405 that leakage is present, the control device 104 may perform control of advancing ignition timing in addition to the above-mentioned procedure at time of leakage in Step S407.

As described above, with the ignition apparatus according to the first embodiment, even when leakage is present between the first electrode and the second electrode of the ignition plug, spark discharge can be reliably generated by operating two high voltage devices at the same period. As a result, the internal combustion engine can be stably operated, and hence discharge of unburnt fuel and the like can be suppressed. Thus, it is possible to contribute to environmental conservation.

Second Embodiment

FIG. 5 is a schematic configuration diagram of an ignition apparatus 2 according to a second embodiment of the present invention. FIG. 5 is a configuration diagram for illustrating an example of the case in which ignition coils are used as the high voltage devices 100A and 100B of FIG. 1 in the same manner as in FIG. 2.

In an ignition apparatus 2 according to the second embodiment of the present invention described below, the function of the leakage current detection device 103 described in the first embodiment is incorporated into one of the high voltage devices. The operation of the ignition apparatus 2 in the case of performing normal spark discharge is the same as that of the ignition apparatus 1 described in the first embodiment, and hence description thereof is omitted.

As illustrated in FIG. 5, the ignition apparatus 2 according to the second embodiment includes high voltage devices 500A and 500B, the ignition plug 101, and the control device 104.

The high voltage device 500A in the second embodiment can have both the function as a high voltage device and the function as a leakage current detection device.

The high voltage device 500A includes a primary coil 501, a secondary coil 502, a switching element 503, a Zener diode 504, a current transformer 505, and a transformer 506. Meanwhile, the high voltage device 500B includes a primary coil 511, a secondary coil 512, a switching element 513, and a Zener diode 514.

The Zener diode 504 in the high voltage device 500A is configured to prevent a current from flowing thereto at a time of accumulation of energy of the high voltage device 500A. The current transformer 505 is configured to detect a current flowing through a leakage path. The transformer 506 has a function of applying a bias voltage for leakage current detection between the first electrode 101*a* and the second electrode 101*b* of the ignition plug 101.

The operation of the ignition apparatus 2 in the case of performing leakage current detection is described.

When the control device 104 outputs an ignition signal [HIGH] to the switching element 503 in the high voltage device 500A, the switching element 503 is brought into a conductive state. Then, the primary coil 501 of the transformer 506 is energized to accumulate energy. During the energization of the primary coil 501, a voltage of hundreds of volts is generated at the secondary coil 502 of the transformer 506. The control device 104 applies the voltage generated at the secondary coil. 502 between the first electrode 101*a* of the ignition plug 101 and the ground as the bias voltage for leakage current detection.

With the above-mentioned configuration, when a leakage path is present between the first electrode 101*a* and the second electrode 101*b*, a current flowing through the current transformer 505 via the secondary coil 502 of the transformer 506 can be detected as a leakage current. That is, in the ignition apparatus 2, the leakage current detection device 103 of the ignition apparatus 1 described in the first embodiment is not required. Therefore, the ignition apparatus 2 can have a configuration simpler than that of the ignition apparatus described in the first embodiment. Further, the leakage current detection device 103 is not required, and hence the number of components can be reduced. Therefore, the ignition apparatus 2 according to the second embodiment can be manufactured at lower cost as compared to the ignition apparatus 1 described in the first embodiment.

FIG. 6 is an explanatory diagram of a leakage current detection period 601 in the second embodiment. The features other than the leakage current detection period 601 are the same as those of FIG. 3 described in the first embodiment.

As illustrated in FIG. 6, the leakage current detection period 601 in the second embodiment is set to a period from the time after energization of the primary coil 501 is started to the time before the energization is interrupted. In this case, the leakage current detection period 601 is set so as not to include energization start time and energization interruption time.

The leakage current detection period 601 is set to the period as illustrated in FIG. 6 because the bias voltage for leakage current detection in the ignition apparatus 2 is generated by energizing the primary coil 501 of the transformer 506 as described above. After interruption of the energization, high voltages required for spark discharge are supplied from the high voltage devices 500A and 500B to the ignition plug 101.

The control device 104 performs processing in accordance with presence of leakage or absence of leakage in the same manner as in the first embodiment based on the detection value of the leakage current flowing through the current transformer 505, which is detected during the leakage current detection period 601. That is, when the control device 104 determines that leakage is present, the control device 104 can reliably generate spark discharge between the first electrode 101*a* and the second electrode 101*b* by driving the high voltage devices 500A and 500B at the same period.

As described above, the ignition apparatus 2 according to the second embodiment can be manufactured in a simpler manner and at lower cost compared to the ignition apparatus 1 described in the first embodiment. Further, with the ignition apparatus 2 according to the second embodiment, even when leakage is present between the first electrode and the second electrode of the ignition plug, spark discharge can be reliably generated by operating two high voltage devices at the same period. As a result, the internal combustion engine can be stably operated, and hence discharge of unburnt fuel and the like can be suppressed. Thus, it is possible to contribute to environmental conservation.

Third Embodiment

In the first embodiment and the second embodiment described above, description is given of examples in which ignition coils are used as the high voltage devices. How ever, the embodiments of the present invention are not limited thereto. In a third embodiment of the present invention, description is given of the case of adopting a configuration in which ignition coils are not used as the high voltage devices as illustrated in FIG. 7.

In the third embodiment described below, unlike the first embodiment and the second embodiment, a high voltage required for spark discharge is applied to the first electrode 101*a* of the ignition plug 101 by a resonance phenomenon caused by AC power. Further, in the third embodiment, the function of the leakage current detection device 103 in the first embodiment described above is implemented by an AC power supply and a current transformer.

FIG. 7 is a configuration diagram of an ignition apparatus 3 according to the third embodiment of the present invention. Description of the configuration common to the first embodiment or the second embodiment is omitted.

The ignition apparatus 3 illustrated in FIG. 7 includes high voltage devices 700A and 700B, a current transformer 703, the ignition plug 101, and the control device 104.

The high voltage device 700A includes a reactor 701 and an AC power supply 702. Further, the high voltage device 700B includes a reactor 711 and an AC power supply 712. Further, the current transformer 703 is connected to the AC power supply 702 of the high voltage device 700A and the ground.

The reactors 701 and 711 each form a resonant circuit together with a floating capacitance of the ignition plug 101.

The timing and frequency for outputting electric power of the AC power supply 702 of the high voltage device 700A and the AC power supply 712 of the high voltage device 700B are controlled by the control device 104 so as to supply an AC current and an AC voltage in the vicinity of a resonant frequency of each resonant circuit.

Next, the operation of the ignition apparatus 3 in the case of performing normal spark discharge is described in the following, the high voltage device 700A is described, but the operation thereof also similarly applies to the high voltage device 700B.

The control device 104 instructs the AC power supply 702 in the high voltage device 700A to output AC power required for the resonant circuit formed by the reactor 701 and the floating capacitance of the ignition plug 101 to cause a resonance phenomenon. Specifically, it is only necessary that the AC power be set to AC power in the vicinity of a resonant frequency of the resonant circuit formed by the reactor 701 and the floating capacitance of the ignition plug 101.

The resonance phenomenon occurs in the resonant circuit formed by the reactor 701 and the floating capacitance of the ignition plug 101 due to the AC power output from the AC power supply 702. With this, the voltage of a midpoint of the resonant circuit, that is, the first electrode 101*a* of the ignition plug 101 is increased.

Due to this increase in voltage, spark discharge is generated between the first electrode 101*a* and the second electrode 101*b*. As a result, the combustible gas mixture in the combustion chamber of the internal combustion engine can be ignited.

Next, the operation of the ignition apparatus 3 in the case of performing leakage current detection is described. When a leakage path is present between the first electrode 101*a* and the second electrode 101*b*, the voltage of the first electrode 101*a* cannot be increased. Therefore, in the same manner as in the first embodiment and the second embodiment, the control device 104 detects presence or absence of leakage and operates the plurality of high voltage devices at the same period when leakage is present, to thereby reliably generate spark discharge.

The leakage current detection is performed with the configuration of the AC power supply 702 of the high voltage device 700A and the current transformer 703 as described below.

The control device 104 instructs the AC power supply 702 in the high voltage device 700A to output electric power, which has a low frequency to such a degree that the influence of the reactor 701 can be ignored, as the bias voltage for leakage current detection.

In this case, a leakage current flowing through the current transformer 703 when a leakage path is present between the first electrode 101*a* and the second electrode 101*b* becomes a current having a frequency band different from that of a resonance current for generating spark discharge. Therefore, the control device 104 can distinguishably detect the leakage current and the resonance current.

That is, the control device 104 can detect, as the leakage current, the current flowing through the current transformer 703 under a state in which the voltage having a low frequency output from the AC power supply 702 is applied between the first electrode 101*a* and the second electrode 101*b* of the ignition plug 101. The leakage current detection period may be set to the leakage current detection period 301 of FIG. 3 in the same manner as in the first embodiment.

The control device 104 performs processing in accordance with presence of leakage or absence of leakage in the same manner as in the first embodiment and the second embodiment based on the detection value of the leakage current flowing through the current transformer 703, which is detected during the leakage current detection period 301. That is, when the control device 104 determines that leakage is present, the control device 104 can reliably generate spark discharge between the first electrode 101.*a* and the second electrode 101*b* by driving the high voltage devices 700A and 700B at the same period.

As described above, the ignition apparatus 3 according to the third embodiment can be manufactured in a simpler manner and at lower cost compared to the ignition apparatus 1 described in the first embodiment and the ignition apparatus 2 described in the second embodiment. Further, with the ignition apparatus 3 according to the third embodiment, even when leakage is present between the first electrode and the second electrode of the ignition plug, spark discharge can be reliably generated by operating a plurality of high voltage devices at the same period. As a result, as in the first embodiment and the second embodiment, the internal combustion engine can be stably operated, and hence discharge of unburnt fuel and the like can be suppressed. Thus, it is possible to contribute to environmental conservation

What is claimed is:

1. An ignition apparatus, comprising:

an ignition plug, which includes a first electrode and a second electrode arranged through intermediation of a gap, and is configured to ignite a combustible gas mixture in a combustion chamber of an internal combustion engine by generating discharge in the gap when a predefined high voltage is applied between the first electrode and the second electrode;

a plurality of high voltage devices each configured to generate the high voltage and apply the high voltage between the first electrode and the second electrode;

a leakage current detection device configured to detect a leakage current flowing between the first electrode and the second electrode; and a control device configured to control respective operations of the plurality of high voltage devices and the leakage current detection device, wherein, in response to the control device determining that leakage is present between the first electrode and the second electrode based on the leakage current detected by the leakage current detection device, the control device increases an output current and causes each of the plurality of high voltage devices to initiate activation of the high voltage between the first electrode and the second electrode at the same period.

2. The ignition apparatus according to claim 1, wherein the control device is configured to control the leakage current detection device so that the leakage current detection device detects the leakage current during a period from a time when exhaust is completed by closing an exhaust valve of the internal combustion engine to a time before combustion is started.

3. The ignition apparatus according to claim 1, wherein the plurality of high voltage devices each include a primary coil and a secondary coil that is magnetically connected to the primary coil, and wherein the control device is configured to cause each of the plurality of high voltage devices to energize the primary coil to accumulate energy and release the energy from the primary coil, when the energization is interrupted, to generate the high voltage at the secondary coil, to thereby apply the high voltage between the first electrode and the second electrode of the ignition plug.

4. An ignition apparatus according to claim 3, wherein the leakage current detection device includes:

a transformer, which is arranged in one of the plurality of high voltage devices, and includes the primary coil and the secondary coil; and a current transformer configured to detect the leakage current flowing through a leakage path at a time of application of a voltage generated at the secondary coil as a bias voltage for detecting the leakage current between the first electrode and the second electrode.

5. An ignition apparatus according to claim 4, wherein the control device is configured to control one of the plurality of high voltage devices in which the leakage current detection device is arranged so as to detect the leakage current during the energization of the primary coil.

6. The ignition apparatus according to claim 1, wherein the leakage current detection device includes:

a power supply configured to apply a bias voltage for detecting the leakage current between the first electrode and the second electrode; and a current transformer configured to detect the leakage current flowing through a leakage path at a time of application of the bias voltage.

7. An ignition apparatus according to claim 1, wherein the plurality of high voltage devices each include a reactor forming a resonant circuit together with a floating capacitance of the ignition plug and an AC power supply, and wherein the control device is configured to cause the AC power supply to output electric power having a frequency capable of resonating the resonant circuit, to thereby apply the high voltage between the first electrode and the second electrode of the ignition plug.

8. An ignition apparatus according to claim 7, wherein the leakage current detection device includes the reactor and the AC power supply, which are included in one of the plurality of high voltage devices, and a current transformer, which is connected between the AC power supply and the ground and is configured to detect the leakage current, and wherein, when the leakage current is detected, the control device causes the AC power supply to output electric power having a frequency lower than the frequency of the electric power for applying the high voltage, to thereby apply a bias voltage for detecting the leakage current between the first electrode and the second electrode of the ignition plug.

9. The ignition apparatus according to claim 1, wherein the plurality of high voltage devices are arranged in the same package.

10. The ignition apparatus according to claim 1, wherein, when the control device determines that the leakage is present between the first electrode and the second electrode, the control device causes each of the plurality of high voltage devices to apply the high voltage between the first electrode and the second electrode at the same period during a predefined ignition number period.

11. The ignition apparatus according to claim 1, wherein, when the control device determines that the leakage is present between the first electrode and the second electrode, the control device controls timing for ignition of the ignition plug so that the timing is present at an advanced side.

12. The ignition apparatus according to claim 1, wherein, in response to the leakage current detection device not detecting the leakage current flowing between the first electrode and the second electrode, the control device is configured to cause only one of the plurality of high voltage devices to generate the high voltage.

13. The ignition apparatus according to claim 1, wherein the ignition plug and the plurality of high voltage devices are configured to generate the discharge in the gap by applying the high voltage from only one of the plurality of high voltage devices when the leakage current is not present.

* * * * *